US007104895B2

(12) United States Patent
Hickey

(10) Patent No.: US 7,104,895 B2
(45) Date of Patent: Sep. 12, 2006

(54) EXTREME SPORTS RAMP SYSTEM

(76) Inventor: Roger William Hickey, 6812 Retherford Dr., Huntington Beach, CA (US) 92647

( * ) Notice: Subject to any disclaimer, the term of this patent is extended or adjusted under 35 U.S.C. 154(b) by 0 days.

(21) Appl. No.: 10/714,107

(22) Filed: Nov. 14, 2003

(65) Prior Publication Data

US 2005/0107171 A1 May 19, 2005

(51) Int. Cl.
*A63C 19/10* (2006.01)

(52) U.S. Cl. ..... 472/89; 472/90; 14/69.5
(58) Field of Classification Search ..... 472/88, 472/89, 90, 91; 14/2.4, 2.5, 69.5
See application file for complete search history.

(56) References Cited

U.S. PATENT DOCUMENTS 4,285,514 A * 8/1981 Romero ..... 472/89
5,347,672 A * 9/1994 Everard et al. ..... 14/69.5
5,870,788 A * 2/1999 Witkin ..... 14/69.5
6,430,769 B1 * 8/2002 Allen ..... 14/69.5
6,695,707 B1 * 2/2004 Fernandez et al. ..... 472/89

OTHER PUBLICATIONS www.Ramptech.com/athome/mod_kicker2.html, internet page Illustrating a "U" profile ramp advertisment. Jun. 20, 2003, one page.
www.domflex.com/en/contact.asp, internet page illustrating a linear ramp system. Jun. 20, 2003, two pages.
www.vertmfg.com/Merchant2/merchant.mv?Screen=PROD&STORE_cODE=vERTmfg . . . web page illustrating a 400 pound curved wooden ramp system.

* cited by examiner

*Primary Examiner*—Kien Nguyen
(74) *Attorney, Agent, or Firm*—Curtis L. Harrington

(57) ABSTRACT

A compact, hinged, foldably deployable ramp is provided in a base configuration which includes three evenly radiused sections which connect to a deck member and have a tube, known as a coping, separating the ramp from the deck. In the base configuration, a top section, mid section and lower section each have a pair of ladder structures which share a middle flange. The deck member includes a pair of angled leg members which are designed to provide support throughout the range of engagement of the ramp. Even size and radiusing of the sections enables continued extension of the ramp by adding sections in conjunction with longer support legs for the deck.

11 Claims, 3 Drawing Sheets

EXTREME SPORTS RAMP SYSTEM

FIELD OF THE INVENTION

The present invention relates to an improvements in providing a stowable, rapidly deployable, modular sports ramp especially valuable for creating various touring setups, and more particularly to a configuration which is easily packed and able to be shipped in palates and which can withstand the extreme forces generated by the use of skateboards, in-line skates, scooters and bicycles while providing a radiused and smooth segment transition.

BACKGROUND OF THE INVENTION

Extreme sports ramps are used in conjunction with skateboards, in-line skates, scooters and bicycles to enable participants to do tricks and to apply controlled upward and downward force along with lateral movement and force. Currently utilized structures range from a board elevated at one end used by beginners to large bulky completely pre-assembled and very heavy one-piece structures. For professionals, it is not unusual for exhibitors of professional talent to carry a crew of carpenters to build structures utilized for performing stunts, as well as to build practice ramps.

The problems thus encountered involve (1) the amount of labor necessary to construct and de-construct the more sturdy ramp structures, (2) the lack of safety inherent in make shift non-engineered structures, not only from falling over but in their lack of provision of an even surface, (3) the space occupied by a structure which cannot be dis-assembled in transport, (4) the space occupied by a structure which can be dis-assembled, (5) the ability to alter the size and shape of the ramp, (6) the provision of a ramp which is enabled to evenly distribute its support load handling capability, and (7) the design to enable the structures to fit together in many different configurations.

Most structures require significant time and expertise to assemble and disassemble, with testing of the structure necessary upon setup to insure integrity. Nearly all non-manufactured ramps have wide variability in their quality and reliability under load. Where an assembly-required ramp kit includes the possibility that structure will be omitted or not assembled consistently, an uneven surface will likely result.

Transport and storage is another problem both with regard to manufacturing and transport to a sales venue, as well as normal stowage and deployment throughout the useful life. If the space occupied by a structure disassembled for stowage is not as small as is practicable, additional transport costs will result in a hidden utilization costs.

Most conventional ramps are fixed, stand-alone units and do not have the ability to have their size and shape altered. Most conventional ramps which are fabricated without plans or without strict adherence to plans result in a ramp which has no ability to evenly distribute its support load handling capability. Most ramps are not engineered to be lightweight, requiring no more than one person to set up, move, fold up and store away.

What is needed is a ramp which is easy to deploy and stow, has built in safety, lightweight without giving up structural inegrity, a consistently reproducible even surface, occupies a small space upon stowage, which can be altered to different sizes without sacrifice in its other characteristics, and always evenly distributes its support load handling capability.

SUMMARY OF THE INVENTION

A compact, hinged, partially foldable deployable ramp is provided in a base configuration which includes three evenly radiused sections which connect to a deck member and have a tube separating the ramp from the deck. In the base configuration, a top section, mid section and lower section each have a pair of ladder structures which share a middle flange. The deck member includes a pair of angled leg members which are designed to provide support throughout the range of engagement of the ramp and are fixed in a position to resist down force through leverage. Even size and computer exacting pre-specified control of the radius of each of the sections enables continued extension of the ramp by adding sections in conjunction with longer support legs for the deck.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
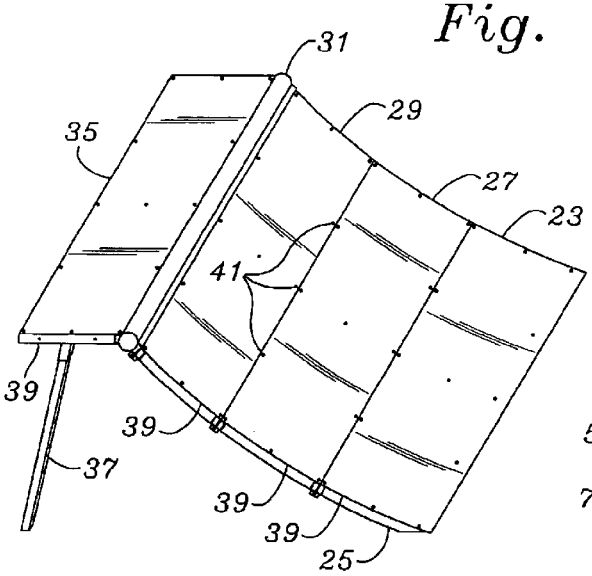
FIG. 1 is a perspective view of the base configuration of the ramp illustrating three assembled sections adjacent the deck section.

The description and operation of the ramp system of the invention will be best described with reference to FIG. 1 which illustrates a perspective view of a base configuration of a ramp system 21. The main sections of the ramp system as seen in this perspective view, from the bottom, include a lower section 23 showing an angled portion 25 to facilitate interface with the ground, a middle section 27 and a top section 29. Adjacent the top section 29 is a curved rail 31 which expresses a cylindrical section and extends the full width of the ramp system 21.

Adjacent the curved rail 31 is a nearly horizontal deck 35. One of the support legs 37 which extends from a position nearly mid-width of the deck section 35 is seen as having a slight angle with respect to the deck 35. The angle of support legs assists support of the deck 35 as users place force against the sections 23, 27 and 29. The sections 23, 27 and 29 are nearly indistinguishable because of the close fit and the fact that each of the sections 23, 27 and 29 is covered with a polymeric sheet of covering material 39 of from about three to five sixteenths inches thick. A series of flat rivets 41 are seen for holding the sheets of covering material 39 in place.

Figure 2:
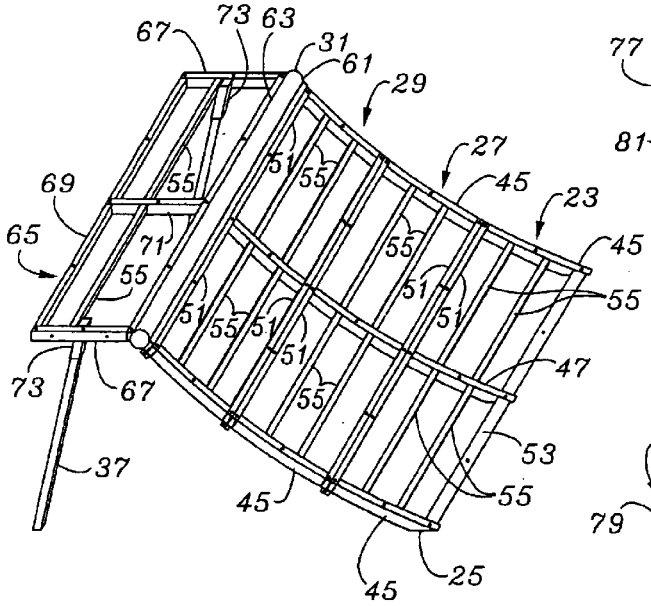
FIG. 2 is a perspective view of the base configuration of FIG. 1 seen from another angle and in which the polymeric covering has been removed to expose the underlying skeletal structure.

Referring to FIG. 2, a perspective view of the base configuration of FIG. 1 seen from another angle and in which the polymeric covering has been removed, exposes and facilitates the underlying skeletal structure of the ramp system 21. Of the sections 23, 27 and 29, section 23 differs in that it is a terminal section having angled portion 25 for forming a more gentle transition from the ground to beginning of the upward curvature of the lower section 23. Angled portion 25 is shown to be a part of a side rail 45. Side rail 45 is preferably made of rectangular steel tubing and has a dimensional size of about 1.5 inches by one inch with a wall thickness of about 0.062 inches. Angled portion 25 is formed by a cut on the first side rails 45 of the lower section 23.

Lower section 23 has a middle rail 47, identical to the size specifications of the side rails 45, and located mid way between the side rails 45. At the outer limits of the lower section 23, the side rails 45 and middle rail 47 are attached to an abutting rail 51 which has the same rectangular tubular size specifications as the side and middle rails 47. Abutting rail 51 is so named as it abuts a similar abutting rail 51 of an adjacently located section, in this case middle section 27.

Opposite the abutting rail 51 is a ground adjacent flat bar 53 which may preferably have lateral dimensions of two inches wide and 0.125 inches thick. Extending between the side rails 45 and middle rail 47 are a series of support rails 55 which have a lateral dimension of one inch by one inch and 0.062 inches thick.

With the exception of the presence of the flat bar 53 and the absence of linking fittings adjacent the flat bar 53, in lieu of a matching abutting rail 51 and underlying fittings, the remaining middle and top sections 27 and 29 are generally identical to the lower section 23. To further illustrate the details of construction of the sections 23, 27 and 29, we next focus our attention on middle section 27.

Middle section 27 has a pair of oppositely disposed matching abutting rails 51. Note how closely and evenly the abutting rails 51 of middle section 27 fit with respect to the upper and lower sections 29 and 23. The extended abutment area of the abutting rails 51 insure a sturdy, even, controllable connection.

Also seen in FIG. 2, adjacent the curved rail 31 is a first rectangular bracket 61 which forms an abutment face against the abutting rail 51 of the top section 29, along with a close abutting fit. On the opposite side of the curved rail 31 is a second rectangular bracket 63 which forms a part of a deck frame 65. The remainder of the deck frame includes a pair of oppositely located side rails 67.

Opposite the second rectangular bracket 63, the side rails 67 attach to an end cross rail 69. A deck middle rail 71 also extends between the second rectangular bracket 63 and the end cross rail 69. The deck frame 65, pair of oppositely located side rails 67, end cross rail 69 and deck middle rail 71 are made of the same material as the side rails 45. A pair of support rails 55, which are the same dimension as the support rails 55 of the lower, middle and top section 23, 27 and 29 provide additional support for the sheet of covering material 39 which covers the deck 35.

Further, the support rails 55 also provide both location and adjacent support for a pair of leg socket members 73. The leg socket members 73 derive support from both the support rails 55 and the adjacent side rails 67 and will preferably be welded to both to utilize the expanded surface area adjacency. The leg socket members 73 are angled to enable the combination of the leg socket members 73 and legs 37 to provide support towards the lower, middle and top section 23, 27 and 29 as users bear mass and force against the front face of the ramp system 21.

Figure 3:
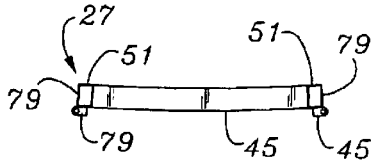
FIG. 3 is a side view of a section illustrating its curvature and lower hinge members.

Referring to FIG. 3, a side view of middle section 27 will be utilized to further emphasize the construction of the ramp system 21. Side rail 45 is seen attached to the abutting rails 51 on either side. The curvature of the side and middle rails 45 and 47 is more clearly seen. It is preferred that the curvature of the side and middle rails 45 and 47 is preferably curved at a 120 inch radius. It is understood that the use of a single middle rail 47 is not limiting and that several may be employed. Further, the ratio of the number of middle rails 47 to the total number of supports can be changed. The addition of other middle rails 47 would likely result in a reduction of the support rails 55 necessary to give an even support to the sheet of covering material 39.

Attached to the bottom of the abutting rails 51 are a set of six hinges 77 of which the two nearest the side rail 45 are seen. The hinges can be pinned and unpinned to enable the lower section 23, middle section 27, and top section 29 to be quickly disassembled from each other. The hinge pins (not shown) may preferably be fitted with cotter pins or other structure which insures that they will not become dislodged from the hinges 77 under use.

It is important to note that the hinges 77 enable the lower section 23, middle section 27, top section 29, and curved rail 31 to pivot with respect to each other. The ability to pivot is only in one direction. Taken with respect to FIG. 2, the lower section 23 can pivot clockwise with respect to middle section 27, the middle section 27 can pivot clockwise with respect to top section 29 and top section 29 can pivot clockwise with respect to the curved rail 31.

However, the weight and ground orientation as seen in FIG. 2 in conjunction with FIG. 3 makes it clear that any pivoting in the other direction results in flat pinching interference between the flat sides 79 which are seen in FIG. 3. The positioning of the hinges 77 are ideally such that the force abutment of the flat sides 79 is spread evenly throughout the area of the flat sides 79. Such spreading will result in a very stable configuration with virtually no "spring" in the ramp surface beyond that which would be had if the ramp surface were either a solid welded matrix of tubing, or if the top section 23, middle section 27, and top section 29 were to be welded to each other.

Figure 4:
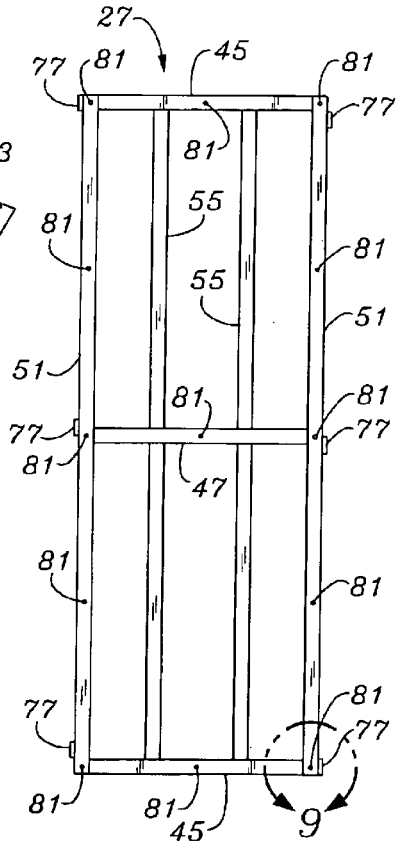
FIG. 4 is a top view of the section seen in FIG. 3.

Referring to FIG. 4, a top view of the middle section 27 reveals the layout of the hinges 77. Only the outer half of the hinges 77 are visible from the top view of FIG. 4. Ideally, the hinge pins (not shown) will have their axial center in alignment with the interspace between two flat sides 79 to be quickly disassembled from each other The layout of hinges 77 reveal that at one abutting rail 51 all of the hinges 77 are located one hinge 77 width toward one of the side rails 45, while on the other abutting rail 51 all of the hinges 77 are located one hinge 77 width toward one other one of thee side rails 45. This gives the middle section 27 a universal interfitability. It makes no difference which abutting rail 51 is oriented toward the adjacent abutting rail 51 of some other section. This makes the whole ramp system 21 much more easily constructed.

FIG. 4 also illustrates one possible layout for a series of small apertures 81 which are used for rivets or fasteners for holding down the sheet of covering material 39. Once the individual skeletal members are constructed to the extent shown in FIG. 2, and whether or not they are in a constructed state, the sheet of covering material 39 is affixed to each of the components of the ramp system 21. The sheet of covering material 39 is exactly cut, preferably with matching apertures so that it may be precisely fit onto each of the lower, middle and top section 23, 27 and 29, and deck 3S.

Precise control and alignment of the lower, middle and top sections 23, 27 and 29, and deck 35 enables precise fitting of pre-cut, pre-aperture aligned sheet of covering material 39. This insures that there is a minimum gap between individual section of the sheets of covering material 39, and that any small gap present does not detract from a force bearing characteristic which approaches continuousness across the ramp surface of the ramp system 21.

In normal usage, the sheets of covering material 39 will be permanently attached to the lower, middle and top section 23, 27 and 29, and deck 35, and any deployment and stowage of the ramp system 21 will be accomplished only by assembly of the main sections to the deck 35 and curved rail 31 assembly.

The overall and specific dimensions of the ramp system 21 may be varied especially to create different sizes and curvatures. The sizes and curvatures may be selected so that the stowed components of the ramp system 21 may fit within pre-determined dimensions. The preferred dimensions of the top and mid sections 29 and 27 include a side rails 45 and middle rail 47 having a length of about 18 inches and an abutting rail 51 having a length of about 47 inches. The support rails 55 have length of about 22 inches.

The top section 29 may differ from the middle section 27 by having a slightly shorter side rails 45 and middle rail 47 of about 16.726 inches for size packing purposes. The version of the ramp system 21 has such a shorter version of the side rails 45 and middle rail 47 and will be illustrated in packing orientation.

The lower section 23 has a side rail 45 having a top length of about 18.5 inches with an angled portion 25 having a length of about 4.271 inches. The angle of angled portion 25 with respect to the top of the side rail 45 of lower section 23 is about ten degrees.

The curvature of the side and middle rail elements 45 and 47 may be achieved on formation or through machine bending. The side and middle rail elements 45 and 47 will have ends which reflect the curvature of the section 23, 27, and 29. The cut of the ends of the rail elements 45 and 47 will need to account for the fact that a portion of the curvature will include the width of two of the support rails 55 which will not themselves have a curvature unless they can be made trapezoidal rather than rectangular in cross section. Admittedly the compression of the upper portions of the support adjacent support rails 55 may compress sufficiently to bring a degree of curvature to the short distance across two adjacent support rails 55.

Legs 37 may be cut rhomboidally to insure that they will engage the ground in an even stance. For a three section ramp system 21 in accord with the dimensions set forth, legs 37 may preferably be about 31.5 inches in length. The angle of the legs 37 normal to flat ground is preferably about 78 degrees with respect to the axis of each of the legs. Legs 37 are also preferably formed of 1.25 inch square steel tubing having a wall thickness of about 0.090 inches. The leg socket members 73 need only have an internal dimension to enable close but slidable accommodation to the insertion of the legs 37, along with two locking bolt mechanisms (to be discussed) to hold legs 37 in place.

The three section ramp of the ramp member 21 with the dimensions set forth will result in a horizontal deck height of about thirty-one inches. The linear length from the center of the curved rail 31 to the lower ground engaging end of the lower section 23 is about fifty six and a quarter inches.

Figure 5:
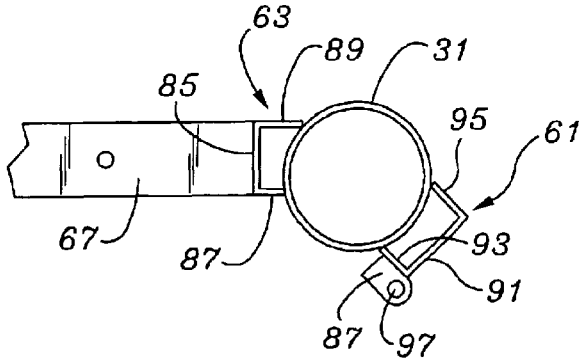
FIG. 5 is a bottom view of the section seen in FIG. 4.

Referring to FIG. 5, a side view looking into the end of the curved rail and adjacent structures is shown. The details of the second rectangular bracket 63 and its attachment of the side rails 67 is shown. The second rectangular bracket 63 has a main plate 85, a lower plate 87 shorter than an upper plate 89. The differences in the length of the plates 87 and 89 enable the deck frame 65 to be supported a little higher on the curved rail 31, or put conversely, it allows the curved rail 31 to have a somewhat lowered profile with respect to the side deck frame 65. The amount of curved rail 31 exposed must be high enough to allow it to be engaged for doing tricks, but not so high that it would prevent a user from easily surmounting it with skateboards, in-line skates, scooters and bicycles etc.

As can be seen, the curved rail 31 is in fact a tubular pipe which is engaged by the first and second rectangular bracket 61 and 63. The curved rail 31 is thus preferably made from a 1.75 inch external diameter pipe having a wall thickness of about one tenth of an inch. From the bottom of the deck frame 65, the bottom of the first rectangular bracket 61 is mounted at an angle of 134.5°. The first rectangular bracket 61 has a hinge member 77 mounted directly to it. This enables the top section 29 to be attached directly to the first rectangular bracket 61 which is welded to the curved rail 31.

The heights of the first and second rectangular brackets 61 and 63 are preferably at one and a half inches to match the height of the deck frame 65 and the height of the lower, middle and top section 23, 27 and 29. First rectangular brackets 61 is also seen as having a main plate 91, a lower plate 93 shorter than an upper plate 95. Hinge member 77 is attached directly to lower plate 93 with its bore 97 positioned to be bisected by the plane of the main plate 91.

Figure 6:
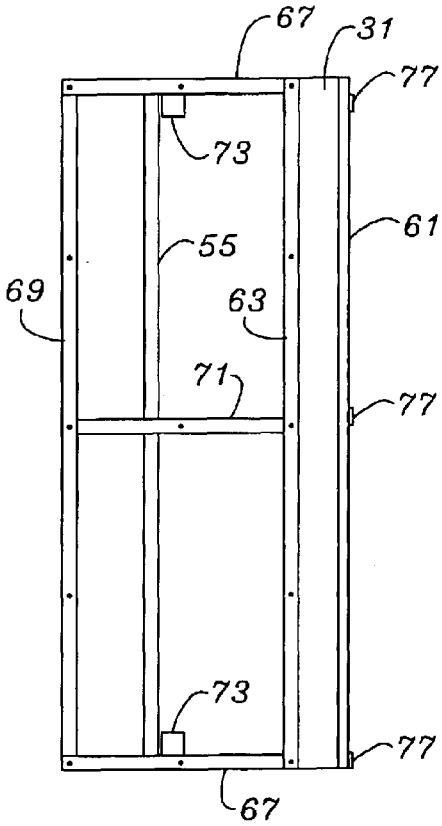
FIG. 6 is a top view of the deck and curved rail.
Figure 7:
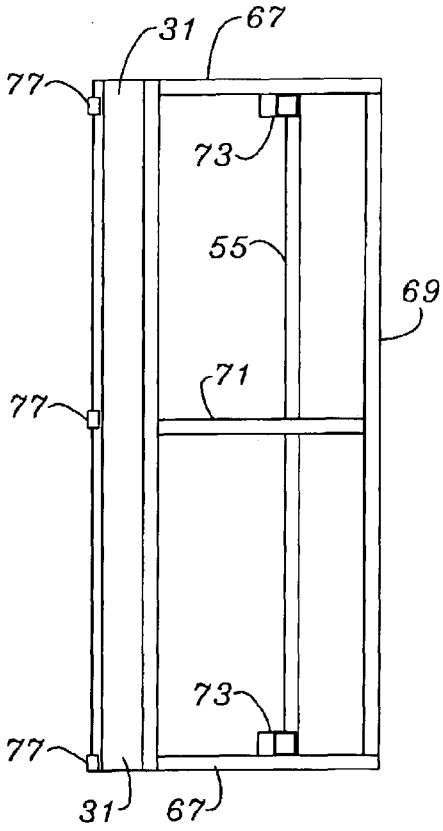
FIG. 7 is a bottom view of the deck and curved rail exposing the details not seen in FIG. 6.

Referring to FIG. 6, a top view of the deck 35 and curved rail 31 is seen. The end cross rail 69 is one of the few rails which does not extend the width of the ramp system 21 and is preferably about 45 inches. The side rails 67 have a length of about 15 inches. The deck middle rail 71 has a length of about 14 inches. A portion of the leg socket members 73 extending underneath the support rails 55 cannot be seen in FIG. 6. Referring to FIG. 7, a bottom view of the deck 35 and curved rail 31 is seen, exposing the details not seen in FIG. 6.

Figure 8:
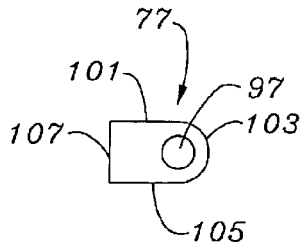
FIG. 8. is an end view of the preferred hinge.

Referring to FIG. 8, an end view of the preferred hinge 77 is seen. The hinge 77 has an overall lug shape having a width of about 0.625 inches and an internal bore 97 having a radius of about 0.328 inches. The hinge 77 has a flat upper side 101 which transitions to a radiused end 103 and then to a flat bottom 105. Radiused end 103 has a radius of about 0.313 inches. Hinge 77 has an flat butt end 107 which is at a right angle with respect to upper and lower sides 101 and 105. The length of the hinge 77 from the butt end 107 to the radiused end 103 is about 1 inch.

Figure 9:
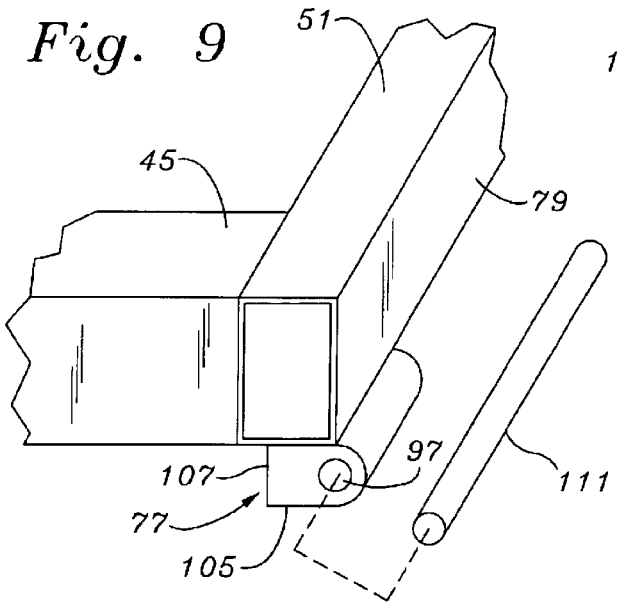
FIG. 9 is an exposed view taken along line 9–9 of FIG. 4 and illustrates a perspective view of the placement of a hinge seen in FIG. 4.

Referring to FIG. 9, an expanded view taken along line 9—9 of FIG. 4 illustrates a perspective view of the placement of a hinge 77 as seen in FIG. 4. The hinge 77 is attached with its flat upper side 101 against the bottom of abutting rail 51. The hinge 77 is positioned so that the bore 97 is about midway into the plane of the flat sides 79 of the abutting rail 51 of the middle section 27. For example, when the middle section 27 is placed adjacent the lower section 23, a hinge 77 of the lower section 23 will align behind the hinge 77 seen in FIG. 9 so that an alignment of the bore 97 in the adjacent hinge 77 will occur with respect to the bore 97 of the hinge 77 shown in FIG. 9. A pin 111 having a length to extend through at least two hinges 77 is employed. Pin 111 may have safety structures, such as a quick pin to prevent dislodgement from its position within bores 97.

Figure 10:
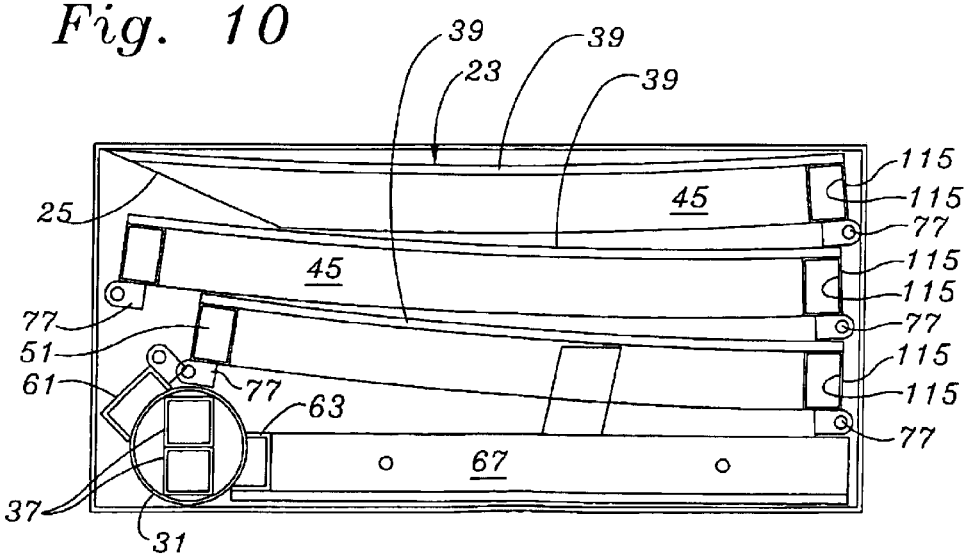
FIG. 10 is a side view of the packaging of the disassembled ramp system.

The packaging of the disassembled ramp system 21 is shown in FIG. 10. A container 115 has a width of about twenty inches and a height of about 9.5 inches. The disassembled members of the ramp system have only two interfits, with the support legs 37 inserted into the tube of the curved rail 31, and the leg socket members 73 fitting into the space between two of the support rails 55 (not seen in FIG. 10) of top section 29. For packing purposes, the top section 29 has been made slightly shorter than the middle section 27.

While the present invention has been described in terms of a ramp system for enabling quick deployment and quick and small size stowage, one skilled in the art will realize that the structure and techniques of the present invention can be applied to many structures, including any structure where construction methodology is facilitated by providing members hinged and designed to stress against hinges to provide a ramp surface which performs as if it were constructed of a solid network of support members.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A ramp system comprising:

a deck member having at least one leg;

a curved rail attached to said deck member; and a curved ramp member hingeably connected to said curved rail to form a load bearing angular relationship with opening hinge movement limited in one direction with respect to said curved rail for supporting both lateral and gravitational force on said curved ramp member, a supporting relationship of said at least one leg, said deck member, said curved rail and said curved ramp member when said ramp system is deployed onto the ground and wherein said curved ramp member further comprises a plurality of sections extending serially away from said curved rail each said section having a first side and a second side and concave in at least one dimension in the direction of said first side, each one of said plurality of sections attached to the other of said plurality of sections at attachment points displaced from said first sides of said sections and wherein said plurality of sections are attached to each other using hinges.

2. The ramp system as recited in claim 1 and wherein said curved ramp member has a radius of curvature of about 120 inches.

3. The adjustable ramp system as recited in claim 1 wherein said first side of said plurality of sections is covered with a sheet of covering material.

4. The adjustable ramp system as recited in claim 1 wherein said at least one leg is angled away from said curved ramp member for providing support throughout a range of engagement of said curved ramp member.

5. A ramp system comprising:

a deck member having at least one leg;

a curved rail attached to said deck member; and a curved ramp member hingeably connected to said curved rail to form a load bearing angular relationship with opening hinge movement limited in one direction with respect to said curved rail for supporting both lateral and gravitational force on said curved ramp member, a supportive relationship of said at least one leg, said deck member, said curved rail and said curved ramp member said ramp system is deployed onto the ground and wherein said curved ramp member further comprises a plurality of sections extending serially away from said curved rail each said section having a first side and a second side concave in at least one dimension in the direction of said first side, each one of said plurality of sections attached to the other of said plurality of sections at attachment points displaced from said first sides of said sections and wherein said plurality of sections utilize a compressive force adjacent said first sides of said sections and a tensile force at said attachment points to maintain structural integrity with respect to forces applied to said first side of each section.

6. The adjustable ramp system as recited in claim 5 wherein said first side of said plurality of sections is covered with a sheet of covering material.

7. The ramp system as recited in claim 5 and wherein said curved ramp member has a radius of curvature of about 120 inches.

8. A ramp system comprising: a deck member having at least one leg; a curved ramp member connected to said deck member to form a load bearing angular relationship with said deck member for supporting both lateral and gravitational force on said curved ramp member, a supportive relationship of said at least one leg, said deck member, and said curved ramp member when said ramp system is deployed onto the ground and wherein said ramp system is deployed onto the ground and wherein said curved ramp member further comprises a plurality of sections extending serially away from said deck member each said section having a first side and a second side and concave in at least one dimension in the direction of said first side, each one of said plurality of sections at attachment points displaced from said first sides of said sections and wherein said plurality of sections are attached to each other using hinges.

9. The adjustable ramp system as recited in claim 8 wherein said first side of said plurality of sections is covered with a sheet of covering material.

10. The adjustable ramp system as recited in claim 8 wherein a curved rail is interposed between said deck member and one of said plurality of sections of said curved ramp member.

11. The ramp system as recited in clim 8 and wherein said curved ramp member has a radius of curvature of said about 120 inches.

* * * * *